US012503329B2

(12) United States Patent
Asano et al.

(10) Patent No.: US 12,503,329 B2
(45) Date of Patent: Dec. 23, 2025

(54) IMAGE FORMING APPARATUS

(71) Applicants: Keisuke Asano, Kanagawa (JP); Ippei Kimura, Osaka (JP)

(72) Inventors: Keisuke Asano, Kanagawa (JP); Ippei Kimura, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 200 days.

(21) Appl. No.: 18/224,069

(22) Filed: Jul. 20, 2023

(65) Prior Publication Data

US 2024/0025689 A1 Jan. 25, 2024

(30) Foreign Application Priority Data

Jul. 22, 2022 (JP) ..... 2022-117054
Apr. 13, 2023 (JP) ..... 2023-065537

(51) Int. Cl.
*B65H 29/24* (2006.01)

(52) U.S. Cl.
CPC ..... *B65H 29/241* (2013.01); *B65H 2301/332* (2013.01); *B65H 2402/44* (2013.01); *B65H 2402/53* (2013.01); *B65H 2406/121* (2013.01); *B65H 2801/03* (2013.01)

(58) Field of Classification Search
CPC ..... B65H 29/247; B65H 29/241; B65H 2301/4461
See application file for complete search history.

(56) References Cited

U.S. PATENT DOCUMENTS 9,821,978 B2 * 11/2017 Herrmann ..... B65H 29/247
2014/0029999 A1 * 1/2014 Masuta ..... B41J 29/377 399/405
2014/0103603 A1 4/2014 Horita et al.
2019/0248609 A1 8/2019 Midorikawa
2020/0218181 A1 7/2020 Midorikawa

FOREIGN PATENT DOCUMENTS

JP 2002-082591 3/2002
JP 2018-017782 2/2018
JP 2019-139160 8/2019
JP 2020-111396 7/2020

* cited by examiner

*Primary Examiner* — Howard J Sanders
(74) *Attorney, Agent, or Firm* — XSENSUS LLP

(57) ABSTRACT

An image forming apparatus includes an ejection port, a stacker, a fan, and a duct. From the ejection port, a sheet is ejected to an ejection space in an ejection direction. The stacker stacks the sheet ejected from the ejection port, and the ejection space is disposed above the stacker. The fan is disposed outside the ejection space to suck air. The duct is connected to the fan. The duct has an exhaust port and a guide. The exhaust port is disposed above the ejection port and downstream from the ejection port in the ejection direction to exhaust the air from the exhaust port toward an upper face of the sheet in the ejection space. The guide connects the fan and the exhaust port to guide the air from the fan to the exhaust port.

17 Claims, 7 Drawing Sheets

IMAGE FORMING APPARATUS

CROSS-REFERENCE TO RELATED APPLICATIONS

This patent application is based on and claims priority pursuant to 35 U.S.C. § 119(a) to Japanese Patent Application No. 2022-117054, filed on Jul. 22, 2022, and No. 2023-065537, filed on Apr. 13, 2023, in the Japan Patent Office, the entire disclosures of which are hereby incorporated by reference herein.

BACKGROUND

Technical Field

Embodiments of the present disclosure relate to an image forming apparatus, such as a copier, a printer, a facsimile machine, or a multifunction peripheral including at least two functions of the copier, the printer, and the facsimile machine.

Related Art

One type of image forming apparatus such as a copier or a printer includes a sheet stacking device on which multiple sheets are stacked. The sheet stacking device includes a stacker such as an output tray. The image forming apparatus forms an image on a sheet and ejects the sheet from an ejection port (a sheet ejection port) of the main body of the image forming apparatus onto the stacker. The sheet is stacked on the stacker.

SUMMARY

This specification describes an improved image forming apparatus that includes an ejection port, a stacker, a fan, and a duct. From the ejection port, a sheet is ejected to an ejection space in an ejection direction. The stacker stacks the sheet ejected from the ejection port, and the ejection space is disposed above the stacker. The fan is disposed outside the ejection space to suck air. The duct is connected to the fan. The duct has an exhaust port and a guide. The exhaust port is disposed above the ejection port and downstream from the ejection port in the ejection direction to exhaust the air from the exhaust port toward an upper face of the sheet in the ejection space. The guide connects the fan and the exhaust port to guide the air from the fan to the exhaust port.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
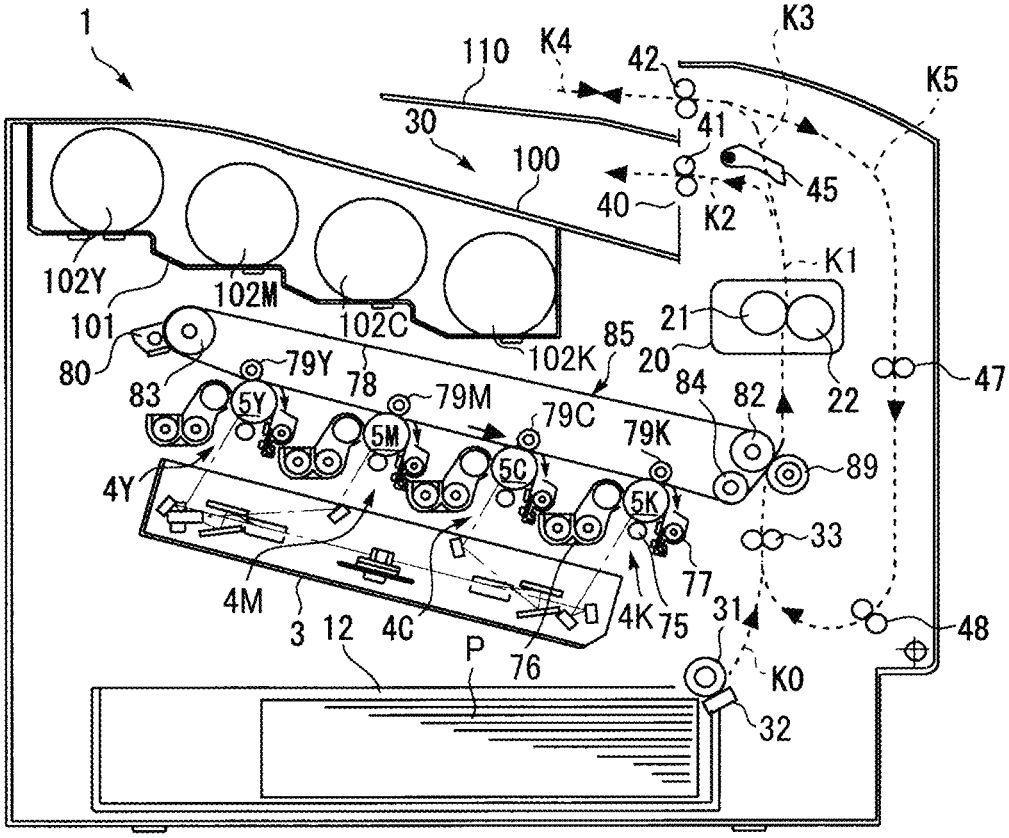
FIG. 1 is a diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below in detail with reference to the drawings. It is to be understood that an identical or similar reference character is given to identical or corresponding parts throughout the drawings, and redundant descriptions are omitted or simplified below.

Referring now to FIG. 1, a description is given of an overall configuration and operations of an image forming apparatus 1 according to a present embodiment of the present disclosure.

As illustrated in FIG. 1, the image forming apparatus 1 according to the present embodiment is a tandem-type color printer. The image forming apparatus 1 includes a bottle housing 101 in an upper portion of the image forming apparatus 1. The bottle housing 101 accommodates four toner bottles 102Y, 102M, 102C, and 102K containing fresh yellow, magenta, cyan, and black toners, respectively, and being detachably attached to the bottle housing 101 for replacement.

Under the bottle housing 101, an intermediate transfer unit 85 is disposed. The intermediate transfer unit 85 includes an intermediate transfer belt 78 as an image bearer facing image forming devices 4Y, 4M, 4C, and 4K arranged side by side corresponding to yellow, magenta, cyan, and black, respectively.

The image forming apparatus 1 includes a sheet feeder 12 (a sheet tray) in a lower portion of the image forming apparatus 1. The sheet feeder 12 contains a stack of multiple sheets P such as sheets of paper stacked on one on another.

In an upper portion of the image forming apparatus 1, The image forming apparatus 1 includes a sheet stacking device 30. After an image is formed on the sheet P, the sheet P is ejected from an ejection port 40 (a sheet ejection port) in a main body of the image forming apparatus 1 and stacked on the sheet stacking device 30.

Above the sheet stacking device 30, the image forming apparatus 1 includes a sheet reversal tray 110 (as a second placing portion). In a doubled-sided print mode, the sheet P is temporarily placed on the sheet reversal tray 110, reversed (switched back), and conveyed to a double-sided conveyance path K5.

The image forming devices 4Y. 4M, 4C, and 4K include photoconductor drums 5Y, 5M, 5C, and 5K, respectively. Each of the photoconductor drums 5Y, 5M, 5C, and 5K is surrounded by a charger 75, a developing device 76, a cleaner 77, a discharger.

Image forming processes including a charging process, an exposure process, a developing process, a primary transfer process, and a cleaning process are performed on each of the photoconductor drums 5Y, 5M, 5C, and 5K, forming yellow, magenta, cyan, and black toner images on the photoconductor drums 5Y, 5M, 5C, and 5K, respectively.

A main motor drives to rotate the photoconductor drums 5Y, 5M, 5C, and 5K clockwise in FIG. 1. The charger 75 disposed opposite each of the photoconductor drums 5Y, 5M, 5C, and 5K uniformly charges the outer circumferential surface thereof in the charging process.

After the charging process, the charged outer circumferential surface of each of the photoconductor drums 5Y, 5M, 5C, and 5K reaches an irradiation position at which an exposure device 3 (in other words, a writing device) irradiates and scans the photoconductor drums 5Y, 5M, 5C, and 5K with laser beams, irradiating and scanning the photoconductor drums 5Y, 5M, 5C, and 5K with the laser beams L forms electrostatic latent images according to yellow, magenta, cyan, and black image data in the exposure process.

After the exposure process, the irradiated and scanned outer circumferential surface of each of the photoconductor drums 5Y, 5M, 5C, and 5K reaches a developing position at which the developing device 76 is disposed opposite each of the photoconductor drums 5Y, 5M, 5C, and 5K, and the developing device 76 develops the electrostatic latent image formed on the respective photoconductor drums 5Y, 5M, 5C, and 5K, thus forming yellow, magenta, cyan, and black toner images on the photoconductor drums 5Y, 5M, 5C, and 5K in the developing process.

After the developing process, the yellow, magenta, cyan, and black toner images formed on the photoconductor drums 5Y, 5M, 5C, and 5K reach primary transfer nips formed between the photoconductor drums 5Y, 5M, 5C, and 5K and the intermediate transfer belt 78 by four primary transfer bias rollers 79Y, 79M, 79C, and 79K pressed against the four photoconductor drums 5Y, 5M, 5C, and 5K via the intermediate transfer belt 78, respectively, and the yellow, magenta, cyan, and black toner images are primarily transferred onto the intermediate transfer belt 78 in a primary transfer process. After the primary transfer process, residual toner failed to be transferred onto the intermediate transfer belt 78 remains on the photoconductor drums 5Y, 5M, 5C, and 5K slightly.

After the primary transfer process, the residual toner on each of the photoconductor drums 5Y, 5M, 5C, and 5K reaches a cleaning position at which the cleaner 77 is disposed opposite each of the photoconductor drums 5Y, 5M, 5C, and 5K, and a cleaning blade of the cleaner 77 mechanically collects the residual toner from each of the photoconductor drums 5Y, 5M, 5C, and 5K in the cleaning process.

Finally, the cleaned outer circumferential surface of each of the photoconductor drums 5Y, 5M, 5C, and 5K reaches a discharging position at which the discharger is disposed opposite each of the photoconductor drums 5Y, 5M, 5C, and 5K, and the discharger eliminates residual potential from each of the photoconductor drums 5Y, 5M, 5C, and 5K.

Thus, a series of image forming processes performed on the photoconductor drums 5Y, 5M, 5C, and 5K is finished.

The yellow, magenta, cyan, and black toner images formed on the photoconductor drums 5Y, 5M, 5C, and 5K in the developing process are primarily transferred onto an outer circumferential surface of the intermediate transfer belt 78 such that the yellow, magenta, cyan, and black toner images are superimposed on the intermediate transfer belt 78. Thus, a color toner image is formed on the surface of the intermediate transfer belt 78.

The intermediate transfer unit 85 includes the intermediate transfer belt 78, the four primary transfer bias rollers 79Y. 79M, 79C, and 79K, a secondary transfer backup roller 82, a cleaning backup roller 83, a tension roller 84, and an intermediate transfer belt cleaner 80.

The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 is coupled to the main motor to drive and rotate the intermediate transfer belt 78 in a rotation direction indicated by an arrow in FIG. 1.

The four primary transfer bias rollers 79Y, 79M, 79C, and 79K sandwich the intermediate transfer belt 78 together with the four photoconductor drums 5Y, 5M, 5C, and 5K, respectively, thus forming the four primary transfer nips between the intermediate transfer belt 78 and the photoconductor drums 5Y, 5M, 5C, and 5K. Each of the primary transfer bias rollers 79Y. 79M. 79C, and 79K is applied with a primary transfer bias having a polarity opposite a polarity of electric charge of toner.

The intermediate transfer belt 78 is moved in the direction indicated by the arrow in FIG. 1 and sequentially passes through the primary transfer nips formed by the primary transfer bias rollers 79Y, 79M, 79C, and 79K. Thus, the toner images formed on the respective photoconductor drums 5Y, 5M, 5C, and 5K are primarily transferred onto the intermediate transfer belt 78 in a manner of being superimposed one atop another to form a composite color toner image on the intermediate transfer belt 78 in the primary transfer process.

Subsequently, the intermediate transfer belt 78 bearing the composite color toner image reaches a position opposite a secondary transfer roller 89. At the position, the secondary transfer backup roller 82 and the secondary transfer roller 89 press against each other via the intermediate transfer belt 78, and the contact portion therebetween is hereinafter referred to as a secondary transfer nip. The four-color toner image formed on the intermediate transfer belt 78 is transferred onto the sheet P conveyed to the position of the secondary transfer nip in a secondary transfer process. At this time, residual toner that is not transferred onto the sheet P remains on the surface of the intermediate transfer belt 78.

The surface of the intermediate transfer belt 78 then reaches a position opposite the intermediate transfer belt cleaner 80. At the position, the intermediate transfer belt cleaner 80 collects the residual toner from the intermediate transfer belt 78.

Thus, a series of transfer processes performed on the intermediate transfer belt 78 is completed.

The sheet P is conveyed from the sheet feeder 12 disposed in the lower portion of the main body of the image forming apparatus 1 to the secondary transfer nip via a first conveyance path K0 and a second conveyance path K1.

Specifically, the sheet feeder 12 contains a stack of multiple sheets P such as sheets of paper stacked on one on another. An uppermost sheet P of the multiple sheets P is nipped between a feed roller 31 and a friction pad 32. Rotating the feed roller 31 counterclockwise in FIG. 1 feeds the uppermost sheet P toward a portion between a registration roller pair 33 as a timing roller pair. Guide plates forming the first conveyance path K0 and the second conveyance path K1 guide the uppermost sheet P to the portion between the registration roller pair 33.

The sheet P conveyed to the registration roller pair 33 serving as the timing roller pair temporarily stops at a position of a roller nip (a nip) of the registration roller pair 33 that stops rotating. Subsequently, the registration roller pair 33 rotates to convey the sheet P to the secondary transfer nip in an image forming section, timed to coincide with the arrival of the color toner image on the intermediate transfer belt 78, Thus, the desired color toner image is transferred onto the sheet P.

After the secondary transfer roller 89 transfers the color toner image onto the sheet P at the secondary transfer nip in the image forming section, the sheet P is conveyed to a fixing device 20 via the secondary conveyance path K1. In the fixing device 20, a fixing belt 21 and a pressure roller 22 apply heat and pressure to the sheet P at a fixing nip formed by the fixing belt 21 and the pressure roller 22 pressing each other to fix the color toner image on the sheet P, which is referred to as a fixing process.

After the fixing process, the sheet P passes through the second conveyance path K1 and is guided to an ejection conveyance path K2 by a bifurcating claw 45 as a switching member, and a sheet ejection roller pair 41 ejects the sheet P from the ejection port 40 to the outside of the image forming apparatus 1. The sheets P ejected one by one by the sheet ejection roller pair 41 to the outside of the image forming apparatus 1 are sequentially stacked as output images on a stacker 100 that is a stack section.

Thus, a series of image forming processes performed by the image forming apparatus 1 is completed.

The above-described operations of the image forming apparatus 1 and movement of the sheet P from the sheet feeder 12 to the stacker 100 in the sheet stacking device 30 are performed when a single-sided print mode is selected. In the single-sided print mode, the image is formed only on the front face of the sheet P.

In the single-sided print mode (and at an end of the double-sided print mode, that is, when the sheet P is ejected to the stacker 100 after the images are printed on both sides of the sheet P), the bifurcating claw 45 as the switching member is at a position (the position illustrated in FIG. 1) after the bifurcating claw 45 rotates counterclockwise about the rotation shaft so as to open the ejection conveyance path K2 and close a relay conveyance path K3.

When a double-sided print mode (a mode in which images are formed on the front face and the back face of the sheet P, respectively) is selected, the image forming apparatus 1 operates as follows, and the sheet P moves as follows.

The processes until the sheet P fed from the sheet feeder 12 reaches the fixing device 20 via the first and second conveyance paths K0 and K1 and the secondary transfer nip are the same as those in the single-sided print mode. After the fixing process (after the image is formed on the front face of the sheet P), the bifurcating claw 45 as the switching member rotates clockwise about the rotation shaft and stops at a position to close the ejection conveyance path K2 and open the relay conveyance path K3. The bifurcating claw 45 as the switching member guides the sheet P to a switchback conveyance path K4 via the relay conveyance path K3.

In the switchback conveyance path K4, a reverse roller pair 42 temporarily stops rotating when the rear end (the rear end in a sheet conveyance direction) of the sheet P reaches the nip of the reverse roller pair 42 after the rear end of the sheet P passes through the branch point between the relay conveyance path K3 and the double-sided conveyance path K5. At this time, the rear end of the sheet P having a fixed image on the front face is held by the reverse roller pair 42, and the front end of the sheet P is held by the sheet reversal tray 110 that is at a position outside the main body of the image forming apparatus 1 and above the stacker 100.

Subsequently, rotating the reverse roller pair 42 in reverse reverses the conveyance direction of the sheet P and conveys the sheet P toward the double-sided conveyance path K5. At this time, the bifurcating claw 45 as the switching member rotates counterclockwise about the rotation shaft and stops at the position to close the relay conveyance path K3 and open the ejection conveyance path K2 and the double-sided conveyance path K5 as illustrated in FIG. 1.

Referring to FIG. 1, the sheet P guided to the double-sided conveyance path K5 is conveyed by a plurality of conveying rollers 47 and 48 disposed in the double-sided conveyance path K5 and guided to the secondary transfer nip. At the secondary transfer nip, an image is secondarily transferred to the back face of the sheet P similar to the secondary transfer process for the front face of the sheet P. After the secondary transfer process, the sheet P is conveyed to the fixing device 20 to perform the fixing process for the back face of the sheet P.

After the fixing process (that is, after the images are printed on both sides of the sheet P), the sheet P is guided to the nip of the sheet ejection roller pair 41 via the ejection conveyance path K2, and the sheet ejection roller pair 41 ejects the sheet P from the ejection port 40 to the outside of the image forming apparatus 1 as described above. As a result, the sheets P are sequentially stacked on the stacker 100 in the sheet stacking device 30.

With reference to FIGS. 2 to 5, the following describes a configuration and operations of the sheet stacking device 30 in the image forming apparatus 1 according to the present embodiment in detail.

Figure 2:
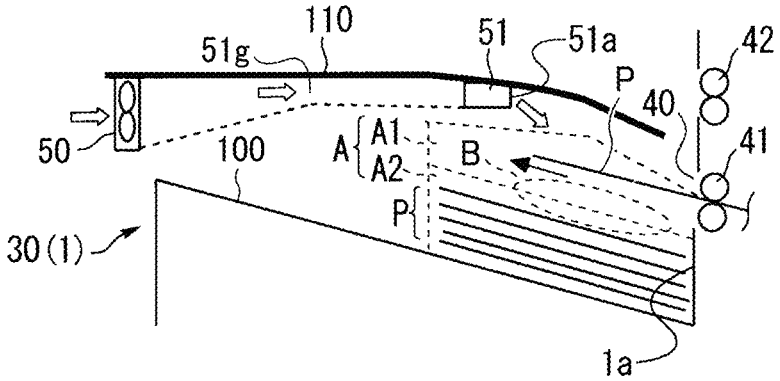
FIG. 2 is a side view of a sheet stacking device.
Figure 3:
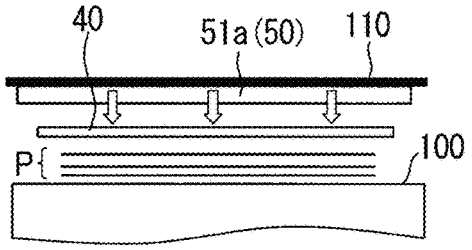
FIG. 3 is a front view of the sheet stacking device.
Figure 4:
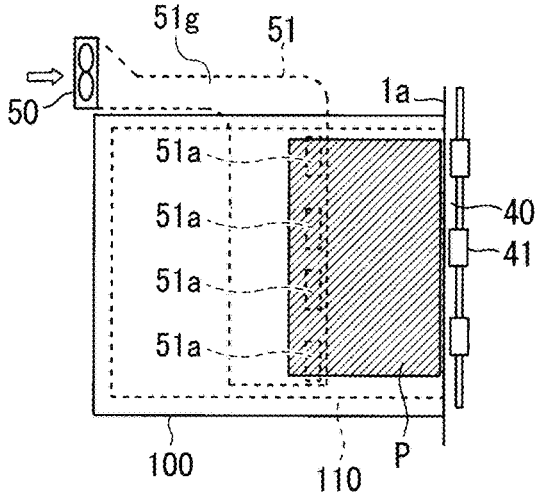
FIG. 4 is a top view of the sheet stacking device.

As illustrated in FIGS. 2 to 4, the sheet stacking device 30 according to the present embodiment includes the stacker 100, a fan 50, and a duct 51.

In addition, the sheet reversal tray 110 is disposed on the main body of the image forming apparatus. The sheet reversal tray 110 serves as a cover over the stacker 100 (and an ejection space A described later).

The sheet P is ejected from the sheet ejection port 40 (that is an opening) in the main body of the image forming apparatus 1 in an ejection direction indicated by an arrow in FIG. 2 and is stacked on the stacker 100.

Specifically, the stacker 100 has an inclined face (as a placement face) that is inclined upward from a position under the ejection port 40 that is the position upstream in the ejection direction (a right side in FIGS. 2 and 4). The inclined face extends from the position upstream in the ejection direction to a position downstream in the ejection direction (a left side in FIGS. 2 and 4).

The sheet P ejected from the ejection port 40 falls by its own weight w % bile receiving a force given by conveyance of the ejection roller pair 41 and a force given by air discharged from a duct 51, which is described later, and is placed on the stacker 100 (or on the sheet P placed on the stacker 100).

The sheet P placed on the stacker 100 slides down along the inclined face of the stacker 100, and a rear end of the sheet P butts a wall 1*a* of the main body of the image forming apparatus 1 (in other words, an exterior portion having the ejection port 40) (See FIG. 2).

As illustrated in FIGS. 2 and 4, the fan 50 is disposed outside the ejection space A.

Specifically, the fan 50 in the present embodiment is, for example, a sirocco fan or the like. The fan 50 is not in a space between the stacker 100 and the sheet reversal tray 110 as the cover. The fan is outside the space. In particular, the fan 50 in the present embodiment is at a position away from the sheet stacking device 30. At the position, the fan 50 can sufficiently suck outside air.

With reference to FIG. 2, the ejection space A has a space A1 and a space A2. The space A1 is defined as a space occupied by the maximum number of sheets P that can be stacked on the stacker 100. The space A2 is defined as a space formed by a trajectory drawn by each sheet P ejected from the ejection port 40 until the sheet P is stacked on the stacker 100. In other words, the ejection space A is formed by trajectories drawn by all of the maximum number of sheets P that can be stacked on the stacker 100 until the sheets P are ejected from the ejection port 40, fall by their own weight, and are stacked on the stacker 100.

Figure 5:
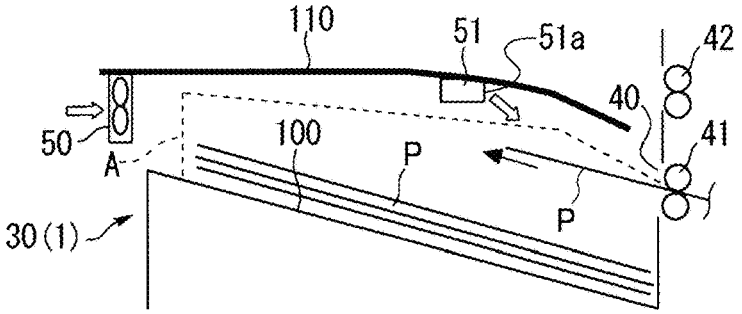
FIG. 5 is a side view of the sheet stacking device on which A3 size sheets are stacked.

The ejection space A illustrated in FIG. 2 is formed by A4 size sheets P. The A4 size is defined by Japanese Industrial Standards (JIS). In FIG. 2, longer sides of A4 size sheet are a right side and a left side of the sheet P. The ejection space A illustrated in FIG. 5 is formed by A3 size sheets P. The A3 size is also defined by JIS. In FIG. 5, shorter sides of A3 size sheet are a right side and a left side of the sheet P.

Figure 6:
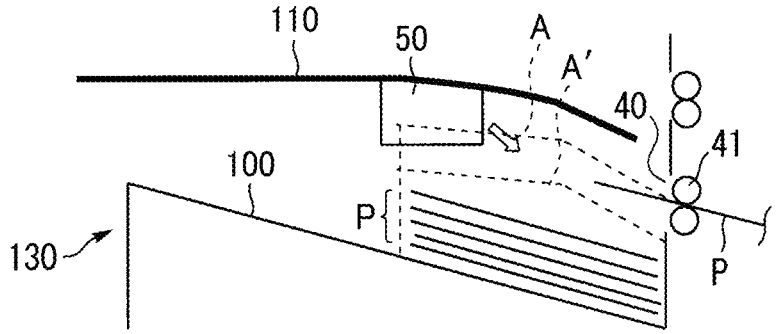
FIG. 6 is a side view of a sheet stacking device according to a comparative embodiment.

The fan 50 in the present embodiment is disposed outside the ejection space A. In contrast, the fan 50 according to a comparative embodiment interferes the ejection space A as illustrated in FIG. 6.

Preferably, the ejection space A in the present embodiment corresponds to ejection spaces of all sizes of sheets used in the image forming apparatus.

The space A2 in the ejection space A described above includes a trajectory along which the leading end of the sheet P drops while hanging downward due to its own weight after the leading end of the sheet P exits from the ejection port 40.

Figure 13:
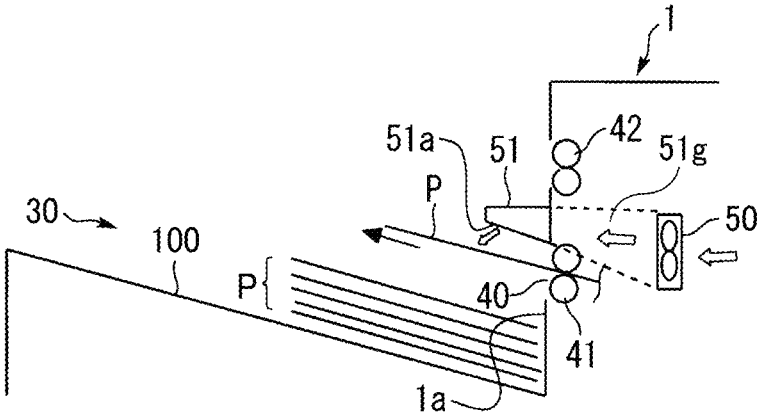
FIG. 13 is a side view of a sheet stacking device according to a seventh modification.

One type of image forming apparatus does not include the sheet reversal tray 110 as the cover, and a part of the sheet P is temporarily ejected from the reverse roller pair 42 (see FIG. 13). In such an image forming apparatus, the ejection space A includes, in addition to the space A1 and the space A2 described above, a space formed by a trajectory drawn by the part of the sheet P while the part of the sheet P is temporarily ejected from the reverse roller pair 42 and is pulled back to the main body of the image forming apparatus 1.

The duct 51 has a guide 51*g* connecting the fan and the exhaust port to guide the outdoor air from the fan 50 to the exhaust port 51*a*.

Specifically, in the present embodiment, the fan 50 is connected to one end of the duct 51 (that is, an upstream end of the duct 51 in an air flow direction) and blows air to one opening at the one end of the duct 51, and the other opening at the other end of the duct 51 (a downstream end of the duct 51 in the air flow direction) serves as the exhaust port 51*a*.

In addition, the duct 51 is disposed on a lower face of the sheet reversal tray 110 as the cover covering over the ejection space A. The duct 51 is attached to the sheet reversal tray 110 as the cover. The duct 51 is positioned not to interfere with the sheet P ejected from the ejection port 40.

The outside air taken in by the fan 50 flows through the guide 51*g* of the duct 51 and is exhausted from the exhaust port 51*a*. The air flow direction is indicated by white arrows in FIG. 2.

The duct 51 in the present embodiment is designed so that the air is exhausted from the exhaust port 51*a* toward the upper face of the sheet P ejected from the ejection port 40 and toward a direction opposite to the ejection direction (that is, the rightward direction in FIGS. 2 and 4). In other words, the duct 51 in the present embodiment has the exhaust port 51*a* having a form to exhaust the air from the exhaust port toward an upper face of the sheet in the ejection space in a direction opposite to the ejection direction.

Specifically, the exhaust port 51*a* of the duct 51 (and the tip of the duct) is directed obliquely rightward below in FIG. 2 (see FIG. 9A). The air exhausted from the exhaust port 51*a* of the duct 51 does not flow toward the ejection direction but flows toward the direction opposite to the ejection direction and is blown onto the upper face of the sheet P. Specifically, the air exhausted from the exhaust port 51*a* of the duct 51 flows downward from the duct 51 (flows obliquely downward to the right in FIG. 2). In other words, the duct 51 blows the air downward from the exhaust port 51*a* to the upper face of the sheet in the ejection space.

The duct 51 is designed so that the air is exhausted from the exhaust port 51*a* toward the ejection space A. In other words, the duct 51 has a form to exhaust the air from the exhaust port toward the ejection space.

In other words, the duct 51 is designed so that the air is exhausted from the exhaust port 51*a* toward the upper face of the sheet P stacked on the stacker 100. That is, the duct 51 blows the air downward in a direction inclined with a vertical direction from the exhaust port 51*a* toward the upper face of the sheet on the stacker 100.

As a result, the air exhausted from the exhaust port 51*a* is directed to the upper face of the sheet P being discharged from the ejection port 40, the upper face of the sheet P before being placed on the stacker 100, and the upper face of the uppermost sheet P of the sheets stacked on the stacker 100.

As described above, the fan 50 in the present embodiment is disposed at a position sufficiently away from the ejection space A, takes the outdoor air, blows the outdoor air into the duct 51, and blows the outdoor air onto the upper face of the sheet P ejected from the ejection port 40.

The air blown onto the upper face of the sheet P sufficiently reduces the floating of the sheet ejected from the ejection port 40, which enhances the stacking property of the sheets P stacked on the stacker 100.

In particular, the fan 50 in the present embodiment is disposed at the position sufficiently away from the ejection space A, takes the outdoor air, blows the outdoor air into the duct 51, and exhausts the outdoor air toward the direction opposite the ejection direction to blow the outdoor air onto the upper face of the sheet P ejected from the ejection port 40. Blowing the air exhausted toward the direction opposite to the ejection direction onto the upper face of the sheet P ejected from the ejection port 40 weakens the force given to the sheet by the conveyance of the sheet ejection roller pair 41. As a result, the sheet P ejected from the ejection port 40 easily falls below due to its own weight, and the stacking property of the sheets P stacked on the stacker 100 is further enhanced.

The air exhausted from the duct 51 is blown to the upper face of the sheet P ejected from the ejection port 40 and the upper face of the uppermost sheet P of the sheets stacked on the stacker 100. In other words, the duct 51 has a form to exhaust the air from the exhaust port toward an upper face of the sheet stacked on the stacker. While the sheet P being ejected from the ejection port 40 and falling toward the stacker 100 moves air from both sides of a space B between the sheet P and the uppermost sheet P of the sheets stacked on the stacker 100 (see FIG. 2) to outsides of the space B in a width direction (that is a direction perpendicular to the surface of the paper on which FIG. 2 is drawn), the sheet P receives force upward. However, blowing the air downward from the duct 51 onto the sheet P ejected from the ejection port 40 generates force pushing the sheet P downward. The force pushing the sheet P downward is larger than the force floating the sheet P upward. As a result, the sheet P easily falls by its own weight, and the stacking property of the sheets P stacked on the stacker 100 is enhanced.

Disposing the fan 50 outside the ejection space A reduces limitations regarding the fan itself and limitations regarding the layout of the fan with respect to the main body of the image forming apparatus 1. In the sheet stacking device 130 according to the comparative embodiment illustrated in FIG. 6, the fan 50 is directly disposed on a lower face of the sheet reversal tray 110 that covers over the stacker 100 in the main body of the image forming apparatus 1, which is likely to cause interference between the fan 50 and the ejection space A. Avoiding such interference between the fan 50 and the ejection space A causes various limitations, such as installing a small fan having a weak air flow rate or setting the ejection space A' low by reducing the maximum number of stackable sheets P as illustrated in FIG. 6.

In contrast, since the sheet stacking device 30 in the present embodiment includes the fan 50 disposed at the position sufficiently away from the ejection space A and the duct 51 having a high degree of freedom in shape and layout and being disposed on the lower face of the sheet reversal tray 110, the above-described various limitations hardly occur.

In addition, the fan 50 disposed outside the ejection space A blows the outside air having a relatively low temperature toward the sheet P and sufficiently cools the sheet P.

The fan 50 disposed close to the ejection space A in the sheet stacking device 130 in the comparative embodiment illustrated in FIG. 6 blows air near the ejection port 40 toward the sheet P. The air near the ejection port 40 has a relatively high temperature due to the influence of the heat of the sheets P after the fixing process. As a result, the sheet P is not sufficiently cooled, and the sheets P stacked on the stacker 100 are likely to be adhered each other by heat (toner softened by heat).

In contrast, the fan 50 in the present embodiment is disposed at the position sufficiently away from the ejection space A and blows the fresh outside air having a relatively low temperature toward the sheet P. As a result, the cooling effect on the sheet P is enhanced, and the disadvantage that the sheets P stacked on the stacker 100 are adhered each other due to heat (toner softened by heat) hardly occurs.

In the present embodiment, the sheet stacking device 30 and the main body of the image forming apparatus 1 do not include a wall forming any one of both ends of the ejection space A in a width direction (that is a direction orthogonal to the ejection direction, a direction perpendicular to the surface of the paper on which FIG. 2 is drawn, a left-right direction in FIG. 3, and a vertical direction in FIG. 4). Specifically, the sheet reversal tray 110 as the cover is disposed above the stacker 100, and the wall 1*a* is disposed upstream from the stacker 100 in the ejection direction. However, no member is disposed downstream from the stacker 100 and at both ends of the stacker 100 in the width direction. The stacker 100 is opened in the width direction and a direction toward downstream in the ejection direction. As a result, the distribution of the ambient temperature in the width direction in the ejection space A is substantially uniform and does not have a portion where the temperature is locally high.

As illustrated in FIG. 4, the duct 51 has multiple exhaust ports 51*a* arranged at intervals in the width direction that is a direction perpendicular to the ejection direction. The duct 51 is designed so that amounts of air exhausted from the exhaust ports 51*a* arranged in the width direction are uniform. As illustrated in FIG. 4, a downstream tip of the duct 51 has multiple exhaust ports 51*a* arranged at intervals in the width direction. In the multiple exhaust ports 51*a*, the interval between adjacent exhaust ports 51*a* in the width direction and the opening area of each exhaust port 51*a* are designed so that the amounts of air exhausted from exhaust ports 51*a* are nearly equal. In the embodiment illustrated in FIG. 4, each of the multiple exhaust ports 51*a* has an identical opening area, and the multiple exhaust ports 51*a* are arranged at equal intervals in the width direction.

In the above-described configuration, the air exhausted from the duct 51 uniformly cools the sheet P ejected from the ejection port 40 and the sheets P stacked on the stacker 100 in the width direction, and the cooling effect on the sheet P is enhanced.

The sheet stacking device 30 (or the main body of the image forming apparatus 1) including walls forming both ends of the ejection space A in the width direction has the ejection space having a substantially uniform temperature distribution in the width direction. As a result, designing the amounts of air exhausted from exhaust ports 51*a* to be nearly equal in the width direction gives an effect similar to the above-described effect.

<Modification 1>

Figure 7:
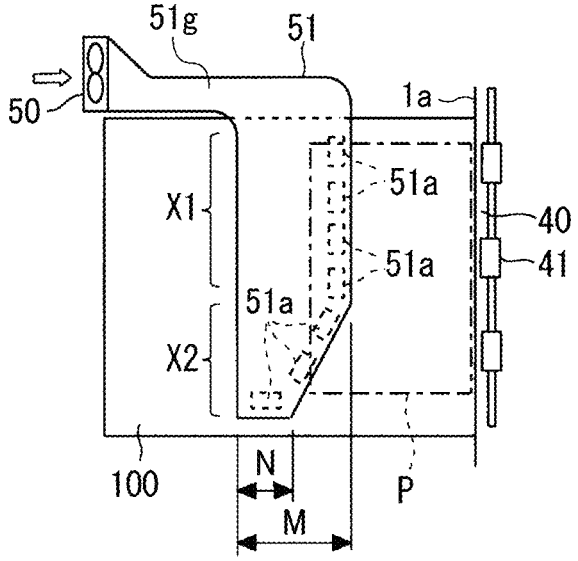
FIG. 7 is a top view of a sheet stacking device according to a first modification.

As illustrated in FIG. 7, the sheet stacking device 30 according to a first modification includes the duct 51 having multiple exhaust ports 51*a* formed at intervals in the width direction.

The duct 51 according to the first modification has an operation portion and a non-operation portion arranged in the width direction that is a direction orthogonal to the ejection direction and a vertical direction in FIG. 7. In FIG. 7, the non-operation portion is an upper portion indicated by a range X1, and the operation portion is a lower portion of the duct 51 indicated by a range X2 and connected to the non-operation portion. A length N of the operation portion X2 in the ejection direction is shorter than a length M of the non-operation portion X1 in the ejection direction (M>N). Under the operation portion X2 in FIG. 7, a user takes out the sheet P stacked on the stacker 100. Accordingly, the operation portion X2 has an end of the duct in the width direction and in a direction in which the sheet stacked on the stacker is taken out, and the non-operation portion X1 has the other end of the duct.

The user often takes out the sheets P stacked on the stacker 100 from an operational area in front of the image forming apparatus 1. The duct 51 having the operation portion X2 with the length N shorter than the length M of the non-operation portion X1 in the ejection direction enhances workability of the above-described operation. Regarding the upstream side of the duct 51 in the ejection direction (that is the right side of the duct 51 in FIG. 7), the non-operation portion X1 has a surface parallel to the width direction, and the operation portion X2 has an inclined surface inclined toward downstream in the ejection direction from the non-operation portion toward the operation area.

The above-described configuration enhances usability when the sheets P stacked on the stacker 100 are taken out.

As illustrated in FIG. 7, the duct 51 according to the first modification has multiple exhaust ports 51*a* arranged at intervals in a direction inclined from the width direction.

Specifically, the non-operation portion X1 has multiple exhaust ports 51*a* arranged side by side at intervals in the width direction, and the operation portion X2 having the inclined surface has multiple exhaust ports 51*a* arranged side by side at intervals in the direction inclined from the width direction. The air blown by the fan 50 flows from the non-operation portion X1 to the operation portion X2 downstream from the non-operation portion X1.

The above-described configuration can set an amount of air exhausted from the exhaust port 51*a* in the non-operation portion X1 (that is an upstream portion of the duct 51) to be substantially equal to an amount of air exhausted from the exhaust port 51*a* in the operation portion X2 (that is a downstream portion of the duct 51). This is because the wind speed is inversely proportional to the air density. Although the air is exhausted from the exhaust ports 51*a* on the way toward the downstream side of the duct and the total mass of the air decreases, reducing a cross-sectional area of the duct 51 can increase the density of the air to substantially uniform the amounts of the air exhausted from the exhaust ports 51*a* from the upstream portion to the downstream portion.

As a result, the air exhausted from the duct 51 uniformly cools the sheet P ejected from the ejection port 40 and the sheets P stacked on the stacker 100 over the width direction, and the cooling effect on the sheet P is enhanced.

<Modification 2>

Figure 8A:
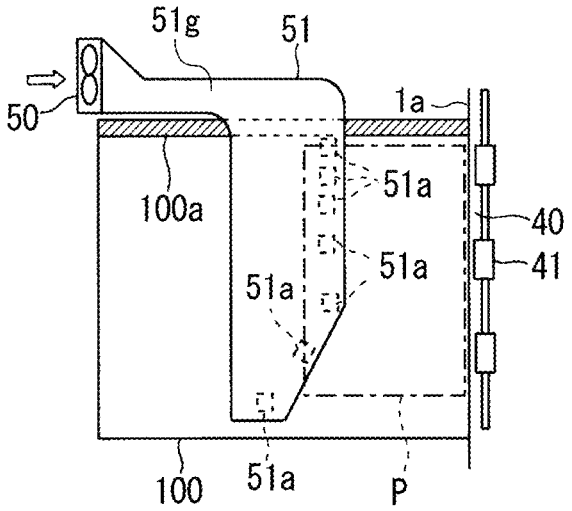
FIGS. 8A and 8B are top views of a sheet stacking device according to a second modification.

As illustrated in FIG. 8A, the sheet stacking device 30 (and the main body of the image forming apparatus 1) according to a second modification includes a wall 100*a* forming one end of the ejection space A in the width direction (that is a top side in FIG. 8A) and extending in a height direction and no wall forming the other end of the ejection space A in the width direction (that is a bottom side in FIG. 8A). The image forming apparatus 1 illustrated in FIG. 12 described later has the same configuration.

The duct 51 of the sheet stacking device 30 illustrated in FIG. 8A is designed such that the amounts of air exhausted from the exhaust ports 51*a* closer to the one end of the ejection space A than to the other end of the ejection space A (in other words, closer to the wall 100*a* than to the bottom side in FIG. 8A) in the width direction is larger than the amounts of air exhausted from the exhaust ports 51*a* closer to the other end of the ejection space A than to the one end of the ejection space A (in other words, closer to the bottom side in FIG. 8A in which no wall exists than to the wall 100*a*) in the width direction.

Specifically, a number of the exhaust ports 51*a* per length in the width direction (in other words, a density) in a part of the duct 51 closer to the one end of the ejection space A than to the other end of the ejection space A is designed to be larger than a number of the exhaust ports 51*a* per length in the width direction (in other words, a density) in a part of the duct 51 closer to the other end of the ejection space A than to the one end of the ejection space A. In other words, the duct has a first portion having first multiple exhaust ports and a second portion having second multiple exhaust ports. The first portion is disposed from one end to a center of the duct in the width direction, and the second portion is disposed from another end to the center of the duct in the width direction. The one end is closer to the wall 100*a* as a side wall of the image forming apparatus than the another end, and the side wall defines the ejection space. A number of the first multiple exhaust ports is larger than a number of the second multiple exhaust ports.

This is because the wall 100*a* prevents heat dissipation from the one end of the ejection space Ain the width direction. In contrast, heat is more easily dissipated from the other end of the ejection space A than from the one end of the ejection space A. As a result, the ambient temperature in the one end of the ejection space A tends to be higher than the ambient temperature in the other end of the ejection space A. In the second modification, increasing the number of the exhaust ports 51*a* in a portion where the ambient temperature is high to intensively increase the amounts of air, thereby enhancing the cooling performance in the portion. As a result, the air exhausted from the duct 51 uniformly cools the sheet P ejected from the ejection port 40 and the sheets P stacked on the stacker 100 over the width direction, and the cooling effect on the sheet P is enhanced.

In other words, the duct 51 illustrated in FIG. 8A is designed such that the amount of the air exhausted from the exhaust ports 51*a* in the width direction is maximized corresponding to a portion of the ejection space A having the highest ambient temperature and gradually decreases with distance from the portion. Specifically, in the duct 51, the number of the exhaust ports 51*a* per length in the width direction (in other words, a density) is set to be maximum in a part of the duct 51 corresponding to the one end of the ejection space A and to gradually decrease toward the other end of the ejection space A.

This is because the ambient temperature is highest at the one end of the ejection space A formed by the wall 100*a* and gradually decreases toward the other end of the ejection space Ain the width direction. In the second modification, the number of exhaust ports 51*a* is increased or decreased in accordance with the level of the ambient temperature to optimize the amount of air exhausted from the duct 51, and cooling is performed so that the ambient temperature does not vary over the width direction. As a result, the air exhausted from the duct 51 uniformly cools the sheet P ejected from the ejection port 40 and the sheets P stacked on the stacker 100 over the width direction, and the cooling effect on the sheet P is enhanced.

Figure 8B:
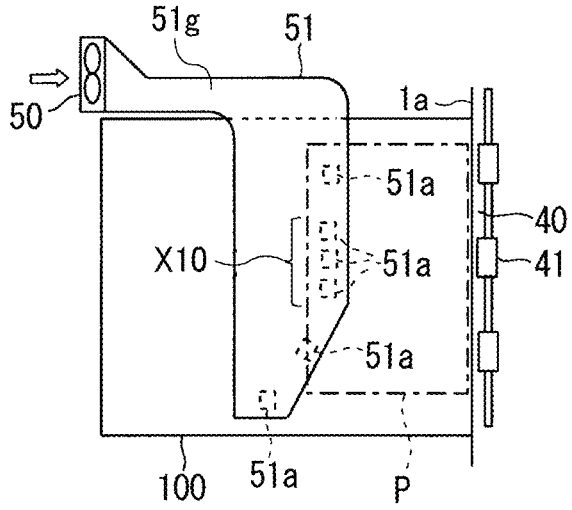

The sheet stacking device 30 illustrated in FIG. 8B does not include a wall at both ends in the width direction.

In the temperature distribution of surface temperatures of the sheet P ejected from the ejection port 40 in the width direction, the temperature tends to be highest at a central portion X10 and gradually lower toward both ends of the sheet Pin the width direction. In other words, in the width direction orthogonal to the ejection direction, the surface temperature of the sheet P ejected from the ejection port 40 is higher at the center portion in the width direction than at both ends in the width direction. This is because heat dissipation from the central portion X10 of the sheet P is harder than heat dissipation from both ends of the sheet in the width direction.

The duct 51 illustrated in FIG. 8B is designed such that the amount of the air exhausted from the exhaust ports 51*a* in the width direction is maximized corresponding to the highest surface temperature portion of the sheet P ejected from the ejection port 40 (that is, the central portion X10 in the width direction) and gradually decreases with distance from the highest surface temperature portion. In other words, the duct 51 is designed such that the amount of air exhausted from the exhaust ports 51*a* facing the central portion of the sheet is larger than the amount of air exhausted from the exhaust ports 51*a* facing each of both ends of the sheet in the width direction. Specifically, in the duct 51, the number of the exhaust ports 51*a* per length in the width direction (in other words, a density) is set to be maximum in a part of the duct 51 corresponding to the central portion X10 to gradually decrease toward both ends of the sheet P. In other words, a number of the exhaust ports in a central region of three regions formed by dividing the duct into three in the width direction orthogonal to the ejection direction is larger than a number of the exhaust ports in one of both end regions of the three regions. In other words, the duct has a first portion having first multiple exhaust ports, a second portion having second multiple exhaust ports, and a third portion having third multiple exhaust ports, the second portion is disposed at a center between the first portion and the third portion in the width direction orthogonal to the ejection direction, and a number of the second multiple exhaust ports is larger than each of a number of the first multiple exhaust ports and a number of the second multiple exhaust ports.

As a result, the air exhausted from the duct 51 uniformly cools the sheet P ejected from the ejection port 40 and the sheets P stacked on the stacker 100 over the width direction, and the cooling effect on the sheet P is enhanced.

<Modification 3>

Figure 9A:
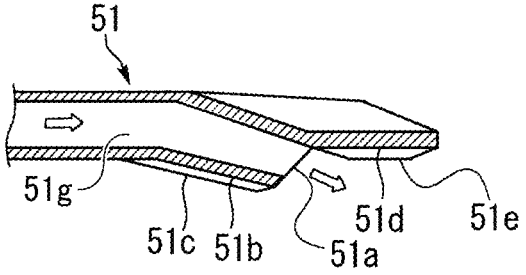
FIG. 9A is a cross-sectional view of a leading end of a duct in a sheet stacking device according to a third modification.

As illustrated in FIG. 9A, a tip of the duct 51 in the sheet stacking device 30 according to a third modification (a portion having the exhaust port 51*a*) has cross-sectional areas decreasing toward the exhaust port 51*a*. The closer to the exhaust port 51*a*, the smaller the cross-sectional area of the duct 51 becomes.

In the above-described configuration, the closer to the exhaust port 51*a*, the larger the density of the air exhausted, which means that the amount (the velocity) of the air exhausted from the exhaust port 51*a* increases. As a result, the various effects obtained by blowing air through the duct 51 described above are efficiently and sufficiently exhibited.

Figure 9B:
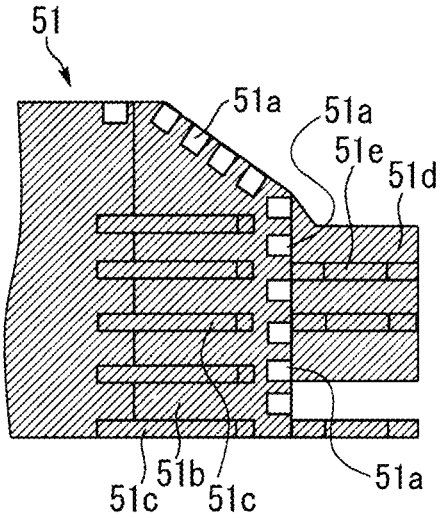
FIG. 9B is a bottom view of the leading end of the duct in the sheet stacking device according to the third modification.

As illustrated in FIGS. 9A and 9B, the duct 51 according to the third modification includes a guide face 51*b* and guide ribs 51*c* that serve as sheet guides, extend toward downstream in the ejection direction, and are disposed in the vicinity of the exhaust port 51*a*. Specifically, the guide face 51*b* as the guide is a lower face of the duct 51 in the vicinity of the exhaust port 51*a*, and guide ribs 51*c* as guides protrude downward from the guide face 51*b*, extend toward downstream in the ejection direction, and are arranged at intervals in the width direction. In other words, the duct 51 according to the third modification includes the guide face 51*b* extending from a lower side of the exhaust port 51*a* toward downstream in the ejection direction and the guide ribs 51*c* protruding downward from the guide face 51*b* and extending toward downstream in the ejection direction. Or, in other words, the duct 51 includes the guide rib 51*c* on a lower face of the duct 51 and extending downstream in the ejection direction, and the guide rib 51*c* is in a vicinity of the exhaust port 51*a*. In the third modification, the guide face 51*b* and the guide ribs 51*c* function as the sheet guide, but the sheet guide is not limited thereto. For example, either the guide face 51*b* or the guide ribs 51*c* may function as the sheet guide.

The guide (such as the guide face 51*b* or the guide rib 51*c*) disposed on the lower face of the tip (that is a portion having the exhaust port 51*a*) of the duct 51 as described above prevents the sheet P from getting caught on the duct 51 even if the sheet ejected from the ejection port 40 contacts the bottom side of the duct 51. As a result, the sheet P slides on the duct 51 with a relatively small frictional force and is guided by the duct 51.

As illustrated in FIG. 9A, the duct 51 according to the third modification has a lower face inclined upward from a lower end of the exhaust port 51*a*, and the lower face extends downstream from the lower end of the exhaust port 51*a* in the ejection direction. The lower face functions as the guide face 51*b* in the vicinity of the exhaust port 51*a*. In other words, the guide face 51*b* in the lower face of the tip of the duct 51 includes an inclined face inclined upward toward the left in FIG. 9A. Accordingly, the sheet P ejected from the ejection port 40 is less likely to be caught by the bottom side of the duct 51, and even if the sheet P is caught by the bottom side of the duct 51, the contact area with the guide face 51*b* can be reduced.

As illustrated in FIG. 9A, the duct 51 according to the third modification includes a guide face 51*d* and guide ribs 51*e* that serve as sheet guides, extend toward upstream in the ejection direction. Specifically, the guide face 51*d* as the guide is an upper face of the duct, the upper face extends from an upper side of the exhaust port 51*a* toward upstream in the ejection direction, and guide ribs 51*e* as guides protrude downward from the guide face 51*d* as the upper face, extend toward upstream in the ejection direction, and are arranged at intervals in the width direction. In the third modification, the guide face 51*d* and the guide ribs 51*e* function as the sheet guide, but the sheet guide is not limited thereto. For example, either the guide face 51*d* or the guide ribs 51*e* may function as the sheet guide.

The guide (such as the guide face 51*d* or the guide rib 51*e*) disposed on the portion upstream (in the ejection direction) from the tip (that is the portion having the exhaust port 51*a*) of the duct 51 as described above prevents the sheet P from getting caught on the duct 51 even if the sheet ejected from the ejection port 40 contacts the duct 51. As a result, the sheet P slides on the duct 51 with a relatively small frictional force and is guided by the duct 51.

<Modification 4>

Figure 10:
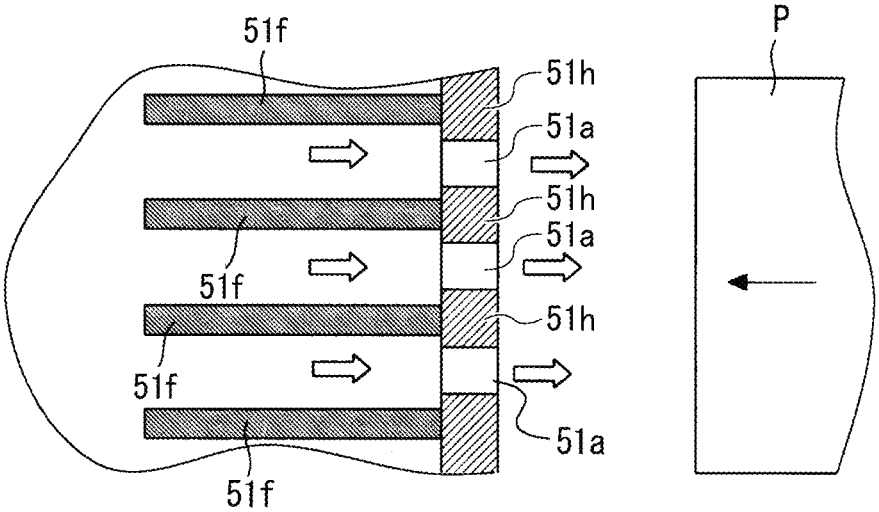
FIG. 10 is an enlarged cross-sectional view of the inside of a leading end of a duct in a sheet stacking device according to a fourth modification.

As illustrated in FIG. 10, the sheet stacking device 30 according to a fourth modification includes baffle plates 51*f* inside the duct 51. The duct 51 includes a side plate 51*h* extending in the width direction and having the multiple exhaust ports 51*a* and multiple baffle plates 51*f* each extending from the side plate 51*h* to an interior of the duct 51 in parallel with the ejection direction The baffle plate 51*f* guides the air so as to be exhausted from the exhaust port 51*a* in parallel with the ejection direction.

The baffle plates 51*f* are arranged side by side at intervals in the width direction inside the duct 51. The baffle plate 51*f* is disposed between neighboring exhaust ports 51*a*. In other words, one of the multiple exhaust ports is between two of the multiple baffle plates in the width direction. Each of the multiple baffle plates 51*f* extends in parallel with the ejection direction. An air flow blown by the fan 50 is separated by the multiple baffle plates 51*f* to be air flows in parallel with the ejection direction. Lengths, positions, and intervals of the baffle plates 51*f* are experimentally determined so as to stabilize the direction of the air flows. Basically, the baffle plate 51*f* extending in parallel with the ejection direction guides the air flow to be in parallel with the ejection direction.

Blowing air from the duct 51 to the sheet P ejected from the ejection port 40 and the sheets P stacked on the stacker 100 in a direction inclined from the ejection direction results in acting a wind force in the direction inclined from the ejection direction on the sheet P, which causes shifting the sheet P in the width direction or skewing the sheet P.

In contrast, the duct 51 in the fourth modification blows the air to the sheet P ejected from the ejection port 40 and the sheets P stacked on the stacker 100 in the direction parallel with the ejection direction. As a result, the above-described disadvantage does not occur.

<Modification 5>

Figure 11:
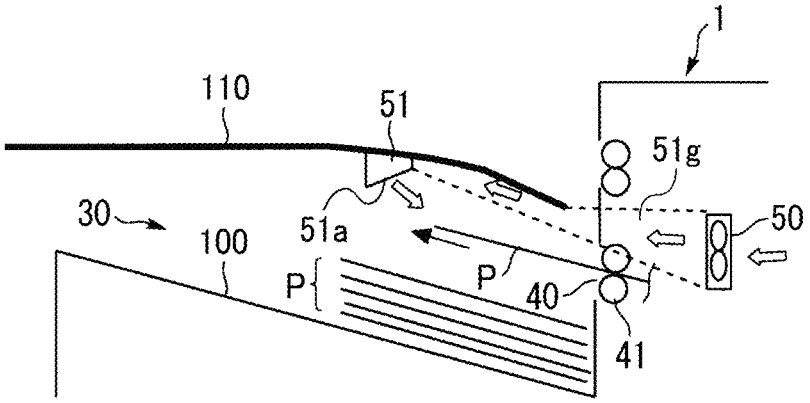
FIG. 11 is a side view of a sheet stacking device according to a fifth modification.

As illustrated in FIG. 11, the sheet stacking device 30 according to a fifth modification includes the fan 50 disposed inside the main body of the image forming apparatus 1 (and outside the ejection space A).

The duct 51 is connected to the fan 50 in the main body of the image forming apparatus 1. Also in the fifth modification, the duct 51 is designed so as to exhaust the air exhausted from the exhaust port 51*a* toward the upper face of the sheet P ejected from the ejection port 40 in the direction opposite to the ejection direction. The fan 50 is disposed at a position where the ambient temperature is relatively low.

The above-described configuration also reduces limitations regarding the fan 50 itself and limitations regarding the layout of the fan with respect to the main body of the image forming apparatus 1, sufficiently reduces the floating of the sheet ejected from the ejection port 40, and sufficiently cools the sheet P.

<Modification 6>

Figure 12:
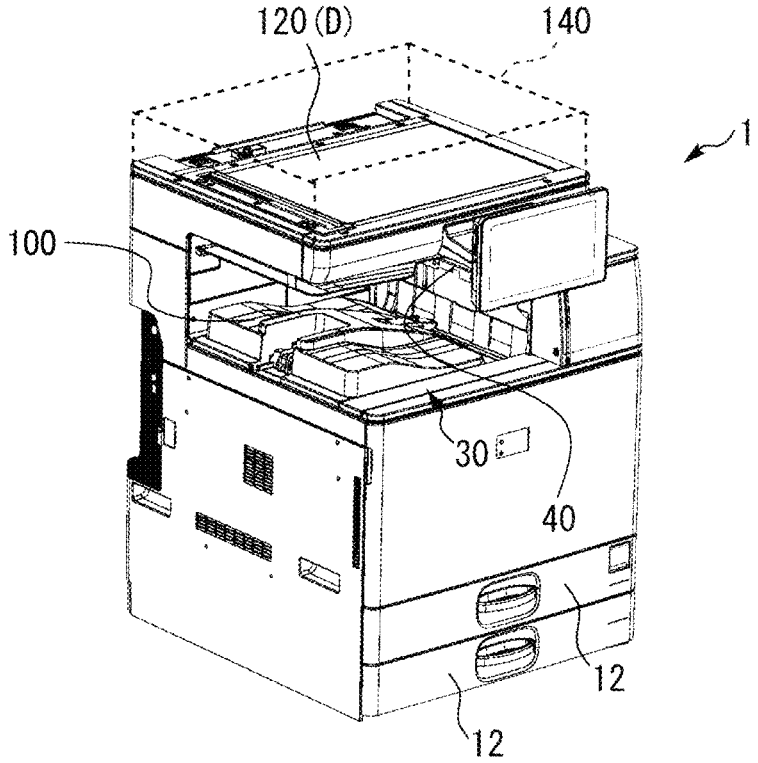
FIG. 12 is a perspective view of an image forming apparatus according to a sixth modification.

As illustrated in FIG. 12, the image forming apparatus 1 according to a sixth modification includes a scanner 120 as the cover covering over the ejection space A in the sheet stacking device 30.

As illustrated in FIG. 12, the image forming apparatus 1 according to the sixth modification is a copier, and the scanner 120 is disposed in an upper portion of the image forming apparatus 1. Under the scanner 120, the image forming apparatus 1 has a space opening toward the operation area in front of the image forming apparatus 1 and opening toward downstream in the ejection direction. In other words, the image forming apparatus 1 includes the sheet stacking device 30 having the space under the scanner 120.

The image forming apparatus 1 includes a pressure plate 140 pressing a document D manually placed on a platen (that is a document table) of the scanner 120. The scanner 120 optically reads image data of the document D placed on the platen.

The image data read by the scanner 120 is transmitted to the exposure device 3 (see FIG. 1). The exposure device 3 irradiates the surfaces of the photoconductor drums 5Y, 5M, 5C, and 5K (see FIG. 1) uniformly charged in the charging process with laser beams (as exposure light) based on the yellow, magenta, cyan, and black image data, respectively. Subsequently, desired images are formed on the surfaces of the photoconductor drums 5Y, 5M, 5C, and 5K through a developing process. The subsequent image forming processes are the same as those described above with reference to FIG. 1.

In the sixth modification, the duct 51 is disposed on the lower face of the scanner 120 serving as the cover. In other words, the duct 51 is attached to the scanner 120 as the cover. The duct 51 is connected to the fan 50 disposed outside the ejection space A. Also in the sixth modification, the duct 51 is designed so as to exhaust the air exhausted from the exhaust port 51*a* toward the upper face of the sheet P ejected from the ejection port 40 in the direction opposite to the ejection direction.

The above-described configuration also reduces limitations regarding the fan 50 itself and limitations regarding the layout of the fan with respect to the main body of the image forming apparatus 1, sufficiently reduces the floating of the sheet ejected from the ejection port 40, and sufficiently cools the sheet P.

<Modification 7>

As illustrated in FIG. 13, the sheet stacking device 30 according to a seventh modification includes the duct 51 disposed above the ejection port 40, and the duct 51 is disposed on the wall 1*a* (the wall surface) as an ejection wall having the ejection port 40.

The sheet stacking device 30 according to the seventh modification includes the fan 50 disposed inside the main body of the image forming apparatus 1 (and outside the ejection space A) similar to the sheet stacking device 30 illustrated in FIG. 11. The sheet stacking device 30 in the seventh modification includes the guide 51*g* as a relay duct (indicated by broken lines in FIG. 13) that relays between the fan 50 disposed inside the main body of the image forming apparatus 1 and the duct 51 protruding toward the outside of the main body of the image forming apparatus 1.

Also in the seventh modification, the duct 51 is designed so as to exhaust the air exhausted from the exhaust port 51*a* toward the upper face of the sheet P ejected from the ejection port 40 in a direction indicated by an inclined white arrow in FIG. 13.

The fan 50 is disposed at a position where the ambient temperature is relatively low.

The above-described configuration also reduces limitations regarding the fan 50 itself and limitations regarding the layout of the fan with respect to the main body of the image forming apparatus 1, sufficiently reduces the floating of the sheet ejected from the ejection port 40, and sufficiently cools the sheet P.

In particular, since the duct 51 in the seventh modification blows air from a position close to the ejection port 40 onto the upper face of the sheet P ejected from the ejection port 40, the cooling effect on the sheet P can be enhanced.

Even if a space between the sheet ejection roller pair 41 and the reverse roller pair 42 is too narrow to place the fan 50, the duct 51 can be placed on the space to cool the sheet P.

In a case in which the size of the fan 50 is larger than a distance on the wall 1*a* between the sheet ejection roller pair 41 and the reverse roller pair 42 in a direction in which the wall 1*a* stands (that is the vertical direction in FIG. 13), it is effective to install the fan 50 inside the main body of the image forming apparatus 1 without placing the fan 50 on the wall 1*a* and form the exhaust port 51*a* of the tip of the duct 51 in the wall 1*a* as in the seventh modification.

As described above, the sheet stacking device 30 according to the embodiments includes the stacker 100 on which the sheet P ejected from the ejection port 40 of the main body of the image forming apparatus 1 in the ejection direction is stacked. The sheet stacking device 30 includes the fan 50 outside the ejection space A to which the sheet P is ejected. In addition, the sheet stacking device 30 includes the duct 51 to guide the air sucked by the fan 50 so as to be exhausted from the exhaust port 51*a*. The duct 51 exhausts the air exhausted from the exhaust port 51*a* toward the upper face of the sheet P ejected from the ejection port 40.

The above-described configuration reduces limitations regarding the fan 50 itself and limitations regarding the layout of the fan with respect to the main body of the image forming apparatus 1, sufficiently reduces the floating of the sheet ejected from the ejection port 40, and sufficiently cools the sheet P.

It is to be noted that the present embodiments of this disclosure are applied to the sheet stacking device 30 provided to the image forming apparatus 1 that performs color image formation. However, this disclosure is not limited to the above-described sheet stacking device (that is, the sheet stacking device 30). For example, this disclosure is also applicable to a sheet stacking device provided to an image forming apparatus that performs monochrome image formation.

Further, it is to be noted that the present embodiments of this disclosure are applied to the sheet stacking device 30 provided to the image forming apparatus 1 that employs electrophotography. However, this disclosure is not limited to the above-described sheet stacking device (that is, the sheet stacking device 30). For example, this disclosure is also applicable to a sheet stacking device provided to an image forming apparatus that employs an inkjet method or a stencil printing machine.

Any of the cases described above exhibits substantially the same advantages as the advantages of the present embodiments.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

In the present embodiments, "air" is not limited to air in a narrow sense (having a normal component ratio) but is defined in a broad sense including not only air having a normal component ratio mixed with another component but also general gas. Accordingly, "air" in this specification may also be read as "gas".

Aspects of the present disclosure are, for example, as follows.

First Aspect

In a first aspect, an image forming apparatus includes an ejection port, a stacker, a fan, and a duct. From the ejection port, a sheet is ejected to an ejection space in an ejection direction. The stacker stacks the sheet ejected from the ejection port, and the ejection space is disposed above the stacker. The fan is disposed outside the ejection space to suck air. The duct is connected to the fan. The duct has an exhaust port and a guide. The exhaust port is disposed above the ejection port and downstream from the ejection port in the ejection direction to exhaust the air from the exhaust port toward an upper face of the sheet in the ejection space. The guide connects the fan and the exhaust port to guide the air from the fan to the exhaust port.

Second Aspect

In a second aspect, the duct in the image forming apparatus according to the first aspect blows the air downward from the exhaust port to the upper face of the sheet in the ejection space.

Third Aspect

In a third aspect, the duct in the image forming apparatus according to the first aspect or the second aspect blows the air downward in a direction inclined with a vertical direction from the exhaust port toward the upper face of the sheet on the stacker.

Fourth Aspect

In a fourth aspect, the image forming apparatus according to any one of the first to third aspects further includes a cover covering the ejection space, and the duct is attached to the cover.

Fifth Aspect

In a fifth aspect, the duct in the image forming apparatus according to any one of the first to fourth aspects has multiple exhaust ports including the exhaust port and being arranged at equal intervals in a width direction orthogonal to the ejection direction, and each of the multiple exhaust ports has an identical opening area.

Sixth Aspect

In a sixth aspect, the image forming apparatus according to any one of the first to fourth aspects further includes a side wall defining a part of the ejection space, and the duct has a first portion and a second portion. The first portion has first multiple exhaust ports including the exhaust port. The second portion has second multiple exhaust ports including the exhaust port. The first portion is disposed from one end to a center of the duct in a width direction orthogonal to the ejection direction. The second portion is disposed from another end to the center of the duct in the width direction. The one end is closer to the side wall than the another end. A number of the first multiple exhaust ports is larger than a number of the second multiple exhaust ports.

Seventh Aspect

In a seventh aspect, the duct in the image forming apparatus according to any one of the first to fifth aspects has a first portion, a second portion, and a third portion. The first portion has first multiple exhaust ports including the exhaust port. The second portion has second multiple exhaust ports including the exhaust port. The third portion has third multiple exhaust ports including the exhaust port. The second portion is disposed at a center between the first portion and the third portion in a width direction orthogonal to the ejection direction. A number of the second multiple exhaust ports is larger than each of a number of the first multiple exhaust ports and a number of the second multiple exhaust ports.

Eighth Aspect

In an eighth aspect, the duct in the image forming apparatus according to any one of the first to seventh aspects has multiple exhaust ports including the exhaust port, and the multiple exhaust ports are arranged at intervals in a width direction orthogonal to the ejection direction.

Ninth Aspect

In a ninth aspect, the duct in the image forming apparatus according to any one of the first to eighth aspects further has multiple exhaust ports arranged at intervals in a direction inclined from the width direction.

Tenth Aspect

In a tenth aspect, the duct in the image forming apparatus according to the ninth aspect further includes a non-operation portion adjacent to the operation portion in the width direction, and the non-operation portion has the multiple exhaust ports arranged at intervals in the width direction. The operation portion has a length shorter than the non-operation portion in the ejection direction.

Eleventh Aspect

In an eleventh aspect, the duct in the image forming apparatus according to any one of the first to tenth aspects includes a side plate and multiple baffle plates. The side plate extends in the width direction and has the multiple exhaust ports. The multiple baffle plates each extends from the side plate to an interior of the duct in parallel with the ejection direction, and one of the multiple exhaust ports is between two of the multiple baffle plates in the width direction.

Twelfth Aspect

In a twelfth aspect, the duct in the image forming apparatus according to any one of the first to eleventh aspects includes a guide rib on a lower face of the duct and extending downstream in the ejection direction, and the guide rib is in a vicinity of the exhaust port.

Thirteenth Aspect

In a thirteenth aspect, the duct in the image forming apparatus according to any one of the first to twelfth aspects includes a guide rib protruding downward from an upper face of the duct and extending in the ejection direction.

Fourteenth Aspect

In a fourteenth aspect, the duct in the image forming apparatus according to any one of the first to thirteenth aspects has a lower face inclined upward from a lower end of the exhaust port, and the lower face extends downstream from the lower end in the ejection direction.

Fifteenth Aspect

In a fifteenth aspect, the image forming apparatus according to any one of the first to fourteenth aspects further includes a sheet reversal tray above the ejection space, and the duct is disposed on a lower face of the sheet reversal tray.

Sixteenth Aspect

In a sixteenth aspect, the image forming apparatus according to any one of the first to fifteenth aspects further includes an ejection wall having the ejection port, and the duct is on the ejection wall above the ejection port.

Seventeenth Aspect

In a seventeenth aspect, the duct in the image forming apparatus according to any one of the first to the sixteenth aspects exhausts the air from the exhaust port toward the upper face of the sheet in a direction opposite the ejection direction.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. An image forming apparatus comprising:

an ejection port from which a sheet is ejected to an ejection space in an ejection direction;

a stacker to stack the sheet ejected from the ejection port, the ejection space disposed above the stacker;

a fan disposed outside the ejection space to suck air; and a duct connected to the fan, the duct including:

an exhaust port disposed above the ejection port and downstream from the ejection port in the ejection direction to exhaust the air from the exhaust port toward an upper face of the sheet in the ejection space; and a guide connecting the fan and the exhaust port to guide the air from the fan to the exhaust port, the image forming apparatus further comprising a side wall defining a part of the ejection space wherein the duct includes:

a first portion including first multiple exhaust ports including the exhaust port; and a second portion including second multiple exhaust ports including the exhaust port, the first portion is disposed from one end to a center of the duct in a width direction orthogonal to the ejection direction, the second portion is disposed from another end to the center of the duct in the width direction, the one end is closer to the side wall than the another end, and a number of the first multiple exhaust ports is larger than a number of the second multiple exhaust ports.

2. The image forming apparatus according to claim 1, wherein the duct blows the air downward from the exhaust port to the upper face of the sheet in the ejection space.

3. The image forming apparatus according to claim 1, wherein the duct blows the air downward in a direction inclined with a vertical direction from the exhaust port toward the upper face of the sheet on the stacker.

4. The image forming apparatus according to claim 1, wherein the duct is attached to a cover of the image forming apparatus covering the ejection space.

5. The image forming apparatus according to claim 1, wherein;

the duct includes multiple exhaust ports including the exhaust port and being arranged at equal intervals in the width direction, and each of the multiple exhaust ports includes an identical opening area.

6. The image forming apparatus according to claim 1, wherein;

the duct includes multiple exhaust ports including the exhaust port, and the multiple exhaust ports are arranged at intervals in the width direction.

7. The image forming apparatus according to claim 6, wherein the duct further includes an operation portion including the multiple exhaust ports arranged at intervals in a direction inclined from the width direction.

8. The image forming apparatus according to claim 7, wherein:

the duct further includes a non-operation portion adjacent to the operation portion in the width direction, the non-operation portion includes the multiple exhaust ports arranged at intervals in the width direction, and the operation portion has a length shorter than the non-operation portion in the ejection direction.

9. The image forming apparatus according to claim 6, wherein;

the duct includes:

a side plate extending in the width direction and including the multiple exhaust ports; and multiple baffle plates each extending from the side plate to an interior of the duct in parallel with the ejection direction, and one of the multiple exhaust ports is between two of the multiple baffle plates in the width direction.

10. The image forming apparatus according to claim 1, wherein:

the duct includes a guide rib on a lower face of the duct and extending downstream in the ejection direction, the guide rib is in a vicinity of the exhaust port.

11. The image forming apparatus according to claim 1, wherein the duct includes a guide rib protruding downward from an upper face of the duct and extending in the ejection direction.

12. The image forming apparatus according to claim 1, wherein the duct includes a lower face inclined upward from a lower end of the exhaust port, the lower face extending downstream from the lower end in the ejection direction.

13. The image forming apparatus according to claim 1, further comprising:

a sheet reversal tray above the ejection space, wherein the duct is disposed on a lower face of the sheet reversal tray.

14. The image forming apparatus according to claim 1, further comprising:

an ejection wall including the ejection port, wherein the duct is on the ejection wall above the ejection port.

15. The image forming apparatus according to claim 1, wherein the duct exhausts the air from the exhaust port toward the upper face of the sheet in a direction opposite the ejection direction.

16. An image forming apparatus comprising:

an ejection port from which a sheet is ejected to an ejection space in an ejection direction;

a stacker to stack the sheet ejected from the ejection port, the ejection space disposed above the stacker;

a fan disposed outside the ejection space to suck air; and a duct connected to the fan, the duct including:

an exhaust port disposed above the ejection port and downstream from the ejection port in the ejection direction to exhaust the air from the exhaust port toward an upper face of the sheet in the ejection space; and a guide connecting the fan and the exhaust port to guide the air from the fan to the exhaust port, wherein the duct includes:

a first portion including first multiple exhaust ports including the exhaust port;

a second portion including second multiple exhaust ports including the exhaust port; and a third portion including third multiple exhaust ports including the exhaust port, and the second portion is disposed at a center between the first portion and the third portion in a width direction orthogonal to the ejection direction, and a number of the second multiple exhaust ports is larger than each of a number of the first multiple exhaust ports and a number of the second multiple exhaust ports.

17. An image forming apparatus comprising:

an ejection port from which a sheet is ejected to an ejection space in an ejection direction;

a stacker to stack the sheet ejected from the ejection port, the ejection space disposed above the stacker;

a fan disposed outside the ejection space to suck air; and a duct connected to the fan, the duct including:

an exhaust port disposed above the ejection port and downstream from the ejection port in the ejection direction to exhaust the air from the exhaust port toward an upper face of the sheet in the ejection space; and a guide connecting the fan and the exhaust port to guide the air from the fan to the exhaust port, wherein:

the duct includes multiple exhaust ports including the exhaust port, the multiple exhaust ports are disposed at intervals in a width direction orthogonal to the ejection direction, the duct further includes an operation portion including the multiple exhaust ports arranged at intervals in a direction inclined from the width direction, the duct further includes a non-operation portion adjacent to the operation portion in the width direction, the non-operation portion has the multiple exhaust ports arranged at intervals in the width direction, and the operation portion has a length shorter than the non-operation portion in the ejection direction.

* * * * *